US008047414B2

(12) United States Patent
Kunz et al.

(10) Patent No.: US 8,047,414 B2
(45) Date of Patent: Nov. 1, 2011

(54) FASTENER DRIVING TOOL HAVING FASTENER DETECTOR IN OUTLET PASSAGE

(75) Inventors: Michael Kunz, Dorndorf (DE); Stefan D. Gensmann, Fruecht (DE); Markus Rompel, Runke/Schadeck (DE)

(73) Assignee: Black & Decker Inc., Newark, DE (US)

( * ) Notice: Subject to any disclaimer, the term of this patent is extended or adjusted under 35 U.S.C. 154(b) by 176 days.

(21) Appl. No.: 12/475,121

(22) Filed: May 29, 2009

(65) Prior Publication Data

US 2009/0294502 A1 Dec. 3, 2009

(30) Foreign Application Priority Data

May 30, 2008 (GB) ..... 0809870.9
Jun. 18, 2008 (GB) ..... 0811155.1

(51) Int. Cl.
*B25C 1/00* (2006.01)

(52) U.S. Cl. ..... 227/2; 227/8; 227/123

(58) Field of Classification Search ..... 227/2, 8, 227/123

See application file for complete search history.

(56) References Cited

U.S. PATENT DOCUMENTS 3,563,438 A * 2/1971 Doyle et al. ..... 227/8
3,578,231 A * 5/1971 Novak ..... 227/123
3,606,128 A 9/1971 Cast et al.
3,762,620 A * 10/1973 Geist ..... 227/8
3,807,619 A * 4/1974 Doyle ..... 227/83
3,934,778 A * 1/1976 Males ..... 227/123
4,405,071 A * 9/1983 Austin ..... 227/7
5,197,646 A * 3/1993 Nikolich ..... 227/8
5,199,506 A * 4/1993 Dewey et al. ..... 173/104
5,199,625 A * 4/1993 Dewey et al. ..... 227/8
5,261,587 A * 11/1993 Robinson ..... 227/8
5,452,835 A * 9/1995 Shkolnikov ..... 227/8
6,857,547 B1 * 2/2005 Lee ..... 227/8
6,883,696 B1 * 4/2005 Steinbrunner et al. ..... 227/8
2002/0158103 A1 * 10/2002 Driscoll et al. ..... 227/123
2005/0023323 A1 2/2005 Jalbert et al.
2005/0218175 A1 * 10/2005 Schell et al. ..... 227/8
2006/0169735 A1 8/2006 Wen

FOREIGN PATENT DOCUMENTS

EP 1 862 262 A1 5/2007

OTHER PUBLICATIONS

Matzdorf, Udo—European Search Report—Oct. 14, 2009—The Hague.

* cited by examiner

*Primary Examiner* — Brian D Nash
(74) *Attorney, Agent, or Firm* — Rhonda L. Barton; Adan Ayala

(57) ABSTRACT

A fastener outlet assembly for a fastener driving tool includes: an outlet passage arranged to expel fasteners from the assembly to a workpiece during use, the outlet passage having one or more walls; and a detector arranged to detect whether a fastener is present in the outlet passage. The detector comprises at least part of a cover that provides at least part of a wall of the outlet passage, the cover being movable with respect to the remainder of the outlet passage to open the outlet passage and gain access thereto.

18 Claims, 8 Drawing Sheets

FASTENER DRIVING TOOL HAVING FASTENER DETECTOR IN OUTLET PASSAGE

BACKGROUND OF THE INVENTION

1. Field of the Invention

The present invention relates to fastener driving tools, and particularly concerns such tools and assemblies in which the fasteners comprise nails. Thus, the tool according to the invention may comprise a nailer. However, the invention also concerns other types of fasteners, including pins, staples, screws, rivets, etc.

2. Description of the Related Art

Many fastener driving tools include a driver that is propelled rapidly against a fastener to drive a fastener from the tool into a workpiece. The driver may comprise a piston, or a ram (impact member), for example. The driver may be propelled in any of a variety of ways, including, but not limited to, pneumatically, by combustion, by means of a strap or chain, by means of a separate piston, or by means of one or more flywheels, for example.

For many years, fastener driving (firing) tools have included a feature whereby a fastener cannot be fired (driven) from the tool unless a nose part of the tool is retracted. This is intended to ensure that the nose part of the tool is pushed against a workpiece, such that the nose part is retracted, before a fastener can be fired from the tool. Some fastener driving tools also include a mechanical detector to detect whether or not a fastener is present in an outlet passage of the tool. If a fastener is not present, a nose part of the tool is prevented from retracting, and thus the tool is prevented from firing a fastener. This is sometimes ret erred to as "dry-fire lock-out", and is an additional feature intended to ensure that if the tool is fired, the energy generated by the tool is (at least partially) expended in firing a fastener from the tool and does not need to be absorbed by the tool. Fastener driving tools including a fastener detector are disclosed in the following U.S. Pat. Nos. 3,606,128; 5,167,359; 6,267,284 B1; 7,059,507 B2; and in U.S. Patent Application Publication US 2007/0290019.

BRIEF SUMMARY OF THE INVENTION

The present invention seeks to provide an improved fastener driving tool, and an improved fastener outlet assembly for a fastener driving tool.

In a first aspect, the present invention provides a fastener outlet assembly for a fastener driving tool, including: an outlet passage arranged to expel fasteners from the assembly to a workpiece during use, the outlet passage having one or more walls; and a detector arranged to detect whether a fastener is present in the outlet passage, the detector including at least part of a cover that provides at least part of a wall of the outlet passage, the cover being movable with respect to the remainder of the outlet passage to open the outlet passage and gain access thereto.

The cover allows access to the outlet passage, for example in order to allow the user to dislodge a fastener that may have become misaligned in the outlet passage, or in order to allow the user to remedy another type of jam or blockage in the outlet passage.

In some embodiments of the invention, the detector includes the cover. However, in preferred embodiments of the invention, the detector includes a part, of the cover. The detector preferably is mounted on the remainder of the cover and is movable relative thereto.

Accordingly, a second aspect of the invention provides a fastener outlet assembly for a fastener driving tool, including: an outlet passage arranged to expel fasteners from the assembly to a workpiece during use, the outlet passage having one or more walls; a movable cover providing at least part of a wall of the outlet passage and being movable with respect to the remainder of the outlet passage to open the outlet passage and gain access thereto; and a detector arranged to detect whether a fastener is present in the outlet passage, the detector being mounted on the cover and movable relative thereto.

It is to be understood that any feature of any aspect of the invention may be a feature of any other aspect of the invention.

Preferably, the detector is rotatably mounted on the cover (or on the remainder of the cover). Advantageously, the detector may be arranged to rotate about an axis oriented substantially perpendicular to a longitudinal axis of the outlet passage. Additionally or alternatively, the detector may be siidably mounted on the cover, for example.

The detector preferably is movable with respect to the remainder of the outlet passage and adopts different positions depending on whether or not a fastener is present in the outlet passage. Advantageously, the detector may be resiliency movable with respect to the remainder of the outlet passage, preferably such that at least a part thereof extends into the outlet passage when a fastener is not present, but is prevented from extending into the outlet passage when a fastener is present. Preferably, the detector is rotatable with respect to the remainder of the outlet passage. Additionally or alternatively, the detector may be siidable (or otherwise movable, e.g. by translational movement) with respect to the remainder of the outlet passage.

Thus, the detector preferably is arranged to extend at least partially into the outlet passage when a fastener is not present (or is not properly located) in the outlet passage. The detector preferably is arranged such that when a fastener is present (and preferably properly located) in the outlet passage, the detector does not extend as far into the outlet passage, and indeed may not extend into the outlet passage at all. Thus, when a fastener is present (and preferably properly located) in the outlet passage, the detector preferably does not hinder the expulsion of the fastener from the outlet passage. Advantageously, at least part of the detector may comprise at least part of a wall of the outlet passage that is arranged to guide a fastener as it is expelled from the passage.

In preferred embodiments of the invention, the fastener outlet assembly further includes a nose part that is resiliently retractable with respect to at least part of the outlet passage. Preferably, at least a front portion of the nose part is situated in front of the cover, in a direction of expulsion of fasteners from the outlet passage. Advantageously, the detector may be arranged to prevent the nose part from retracting when a fastener is not present in the outlet passage, and preferably to allow the nose part to retract when a fastener is present. Preferably, the fastener driving tool is prevented from driving a fastener into a workpiece when the nose part is prevented from retracting.

The detector preferably includes a protrusion that extends out of the outlet passage and is positioned to block the retraction of the nose part when a fastener is not present in the outlet passage, and preferably to allow such retraction when a fastener is present. Advantageously, at least part of the protrusion may be visible from the exterior of the assembly and may serve as an indicator as to whether or not a fastener is present in the outlet passage, e.g. by virtue of its position relative to the cover.

Preferably, the nose part includes a first elongate part extending backwards from the front portion. The protrusion of the detector may be arranged to block the backwards movement of the first elongate part when a fastener is not present in the outlet passage, for example.

Advantageously, the nose part may include a second elongate part extending backwards from the front portion. The backwards movement of the second elongate part, when the nose part retracts, may enable the tool to drive a fastener into a workpiece. Thus, the second elongate part may comprise part of the above mentioned mechanism, whereby a fastener cannot be driven from the tool unless the nose part of the tool is retracted. Such a mechanism is intended to ensure that the nose part of the tool is pushed against a workplace (such that the nose part is retracted) before a fastener can be fired from the tool.

The cover may be rotatable with respect to the remainder of the outlet passage. Preferably, the cover is arranged to rotate about an axis oriented substantially perpendicular to a longitudinal axis of the outlet passage. Additionally or alternatively, the cover may be removable from the remainder of the outlet passage.

A third aspect of the invention provides a fastener driving tool arranged to drive fasteners into a workpiece, the tool including a fastener outlet assembly according to the first or second aspect of the invention.

Preferably the fasteners comprise nails and the tool includes a nailer.

The fastener driving tool may drive or fire fasteners from the tool in any convenient manner. For example, the tool may include one or more (e.g. one or two) flywheels or other inertial members arranged to impart kinetic energy to a driver or other member, to drive or fire fasteners from the tool. Alternatively, the tool may drive or fire fasteners by means of compressed gas and/or combustion, for example. The tool may be electrically or pneumatically powered, or powered in any other convenient manner. Preferably, however, the tool is electrically powered, by mains electricity and/or by means of one or more batteries or other portable electrical powering devices.

The fastener outlet assembly preferably includes a magazine including one or more supply channels arranged to hold fasteners and supply them to the outlet passage. In some preferred embodiments of the invention, the magazine includes two or more supply channels, for example exactly two supply channels. However, in other embodiments of the invention, the magazine may comprise three, four, five or more supply channels. Preferably, the supply channels are arranged substantially parallel to each other, but other arrangements are contemplated. The supply channels preferably are separate from each other. If the magazine includes two or more supply channels, the assembly preferably includes a channel selector arranged to selectively connect the outlet passage with each respective supply channel of the magazine.

The part of the outlet passage wall(s) that is provided by the cover may comprise part of the length and/or part of the circumference of the wall(s) of the outlet passage. Thus, the cover may provide at least part of the outlet passage wall(s) in combination with a housing part, and/or a nose part, and/or a channel selector, for example.

The magazine preferably includes at least one urging assembly arranged to urge fasteners toward the outlet passage, in use. Advantageously, each supply channel of the magazine (if there is more than one supply channel) may include a respective urging assembly. The (or each) urging assembly preferably includes a roll spring. The (or each) urging assembly may generally have a form, including a pusher part which may be resiliency rotatable into, and out of, engagement with the fasteners to be urged toward the outlet passage. Preferably, the (or each) pusher part (which pushes the fasteners) is itself pulled toward the outlet passage, for example by means of a roll spring. Alternatively, however, the pusher part(s) may be arranged to be pushed toward the outlet passage.

In preferred embodiments of the invention, fasteners held in supply channels of the magazine are arranged to be supplied to the outlet passage by passing through an opening in the channel selector. Preferably, the channel selector provides at least part of the wall(s) of the outlet passage. For example, the channel selector may comprise the opening, at least part of the wall(s) of the outlet passage, and a delivery channel situated between the outlet passage and the opening, by which the opening communicates with the outlet passage.

The fastener outlet assembly preferably includes a housing part (e.g. as mentioned above), on which the cover is movably mounted (e.g. removably mounted), for example by means of a latch, especially an over-centre latch. The cover preferably is mounted on an upper part (as the tool is used and regarded) of the housing, preferably on an opposite side of the housing to a magazine for the fasteners.

Advantageously, a channel selector (e.g. as mentioned above) may be at least partially housed in the housing part. The channel selector may, for example, be rotatably arranged in the housing part. Preferably, the channel selector includes at least one protrusion projecting outside the housing part, by which the channel selector can be manipulated. In preferred embodiments of the invention, the channel selector includes two such protrusions, preferably located on opposite sides of the outlet passage.

As described above, in preferred embodiments of the invention the fastener outlet assembly includes a nose part that provides at least part of the outlet passage. The nose part may include a fixed tubular part, to provide at least part of the length of the outlet passage, preferably arranged forwardly of the cover. Preferably, a retractable portion of the nose part is retractable with respect to such a fixed tubular part, and preferably the tubular part is at least partially contained in the housing part.

BRIEF DESCRIPTION OF THE DRAWINGS

Preferred embodiments of the invention, will now be described, by way of example, with reference to the accompanying drawings, of which.

DETAILED DESCRIPTION OF THE INVENTION

Figure 1:
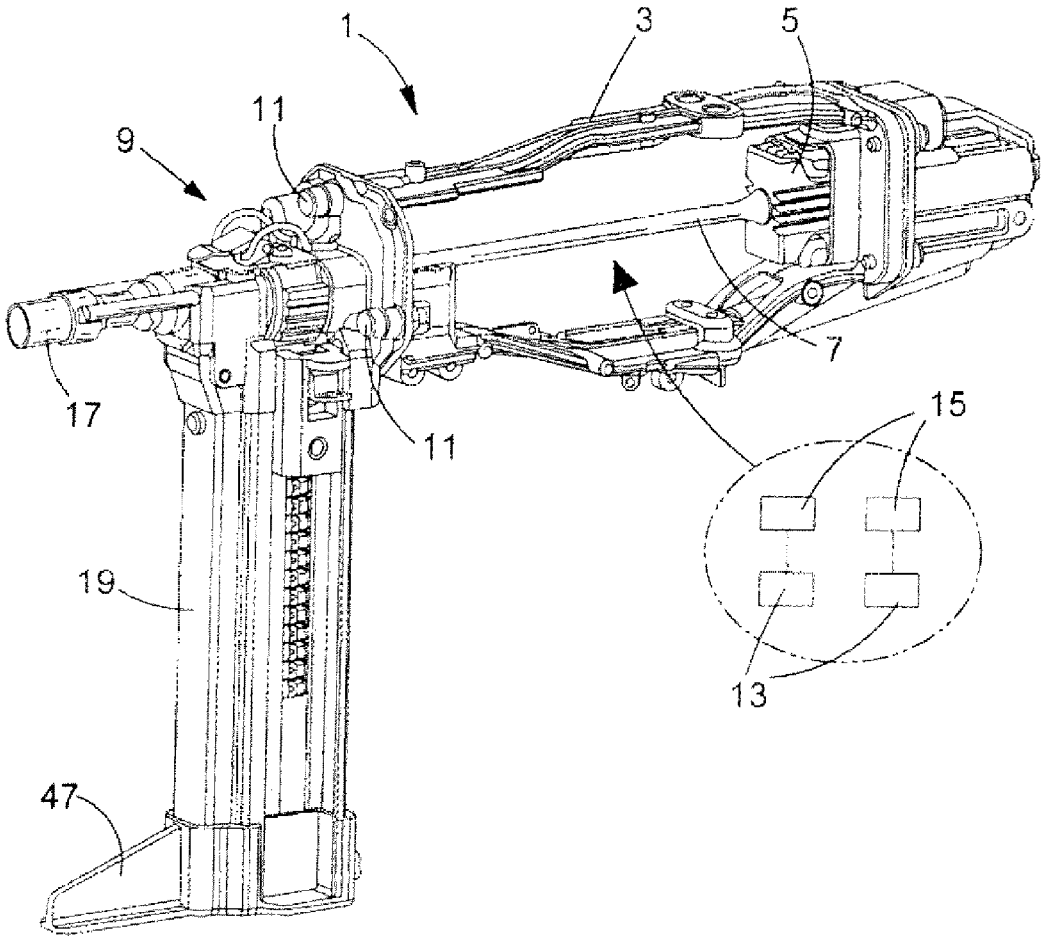
FIG. 1 shows a fastener driving tool according to the invention.
Figure 2:
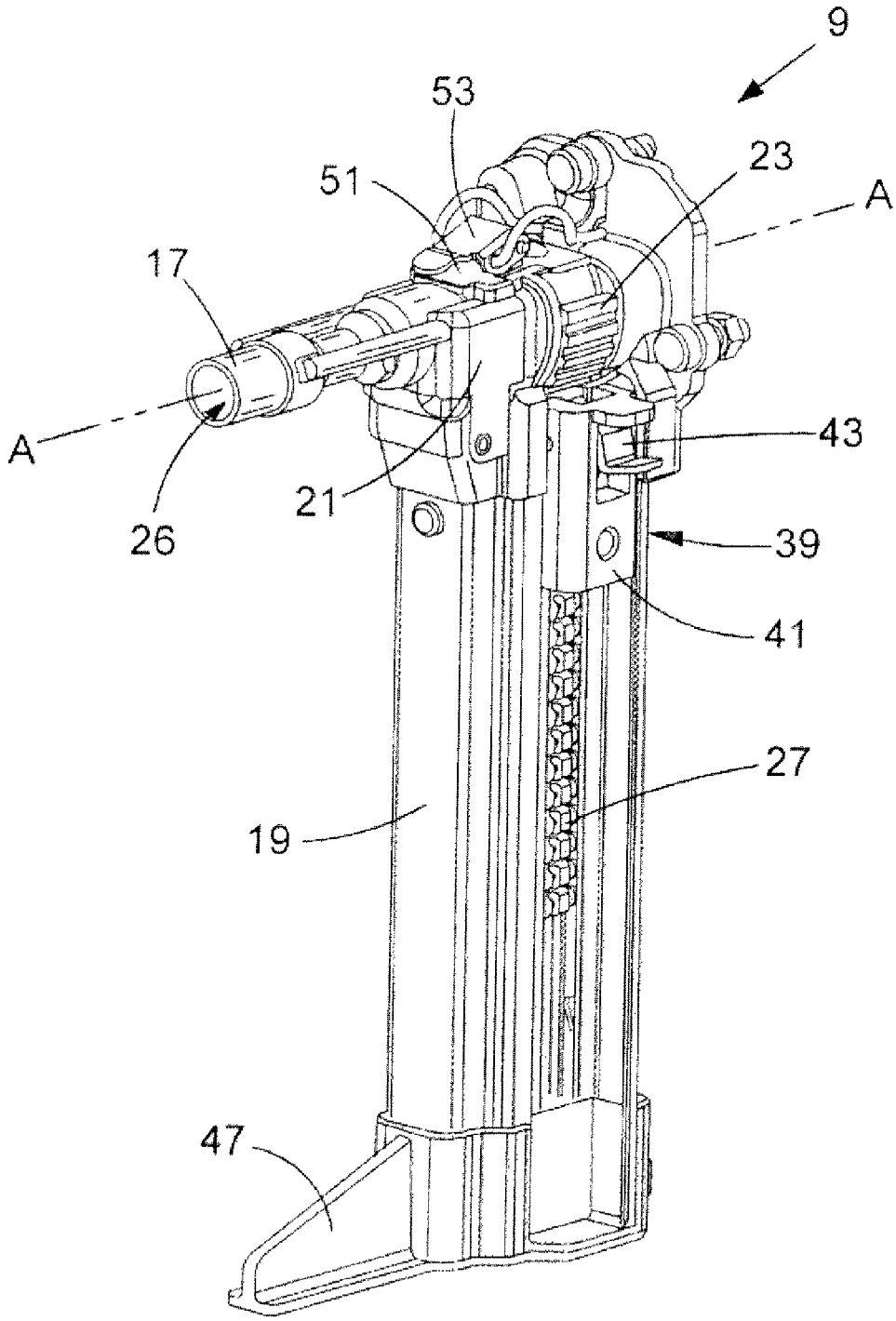
FIGS. 2 to 9 are views of a fastener outlet assembly according to the invention, and components thereof.
Figure 3:
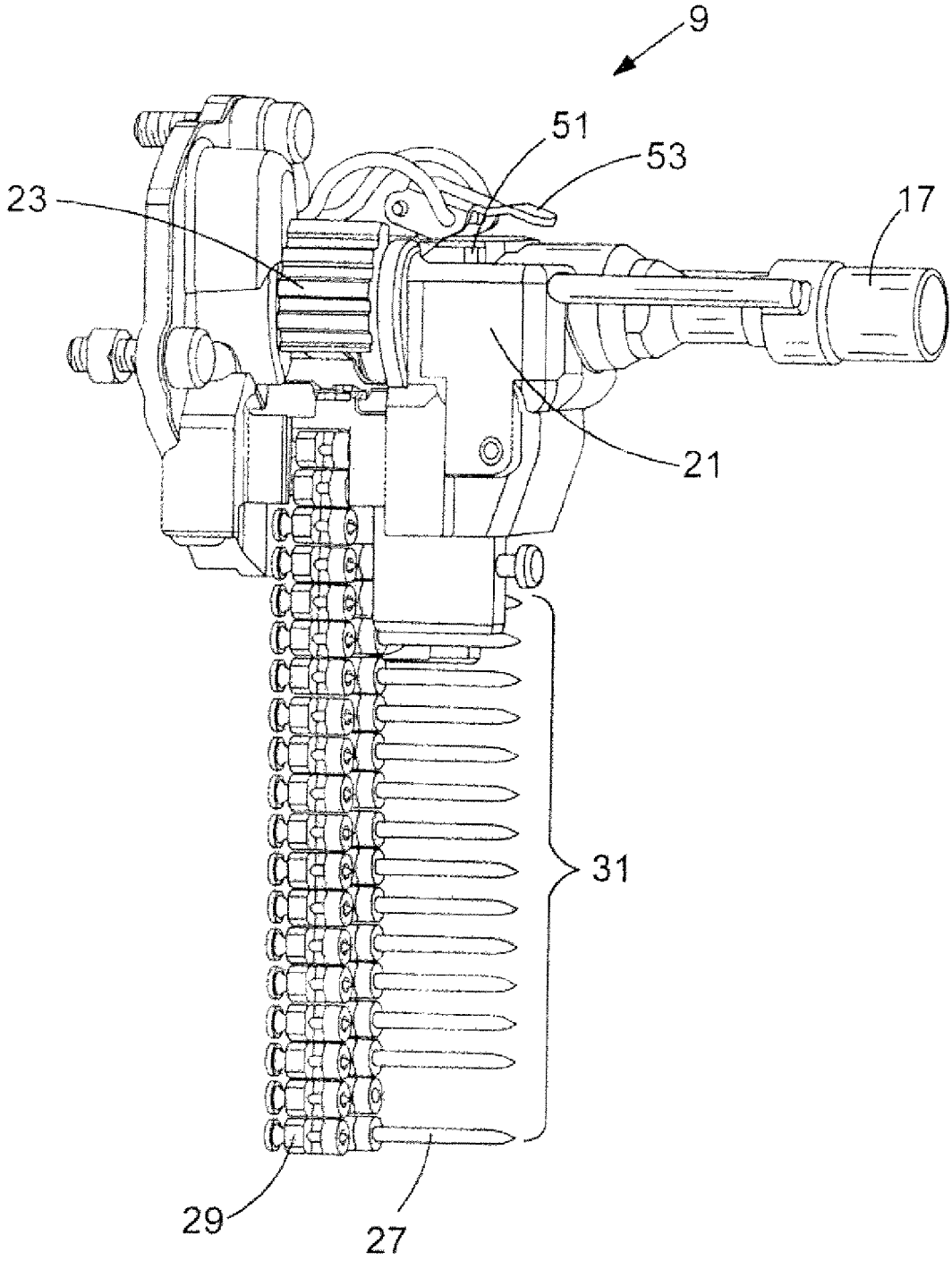

FIG. 1 shows a fastener driving tool 1 according to the invention, including a main body 3, a driver 5, a ram 7 attached to a front part of the driver 5, and a fastener outlet assembly 9 according to the invention, attached, to a front part of the main body 3, for example by means of screws 11. As indicated schematically, the fastener driving tool 1 may include two electric motors 13 and two flywheels 15, each flywheel being powered by a respective motor 13. Not shown, but provided in a conventional manner, the fastener driving tool 1 includes a handle, a trigger for firing the tool, and a rechargeable (and removable) battery for powering the motors 13. The fastener outlet assembly 9 includes a resiliency retractable nose part 17.

The fastener driving tool 1 is arranged such that when a user wishes to drive or fire a fastener (e.g. a nail) into a workpiece (not shown), the user pushes the nose part 17 of the tool against the workpiece, causing the nose part to retract. This allows the tool to drive a fastener into the workpiece, once the trigger is pulled. The trigger may be pulled before or after the nose part 17 is retracted (but if pulled before the nose part is retracted, the trigger must remain pulled while the nose part is retracted) to cause the fastener to be fired into the workpiece. When the trigger is in a pulled condition and the nose part is in a retracted condition, the electric motors 13 cause the flywheels 15 to propel the driver 5 forward, thereby causing the ram 7 (which is attached to the front of the driver 5) to expel a fastener from the tool and fire it into the workpiece. Such firing arrangements are known to persons skilled in the art, and are not described in further detail herein.

FIGS. 2 to 9 show a fastener outlet assembly 9 according to the invention, and components thereof. As explained above, the fastener outlet assembly 9 is attached to the front of the main body 3 of the fastening driving tool by means of screws 11. The fastener outlet assembly 9 includes a magazine 19, a housing part 21, a nose part 17, and a channel selector 23. A pivotable cover 51 is secured to the top of the housing part 21 by means of an over-centre latch 53. An outlet passage 26 (from which fasteners are fired from the tool) extends through the nose part 17 and channel selector 23, and has a longitudinal axis A-A. Both the nose part 17 and the channel selector 23 are partially housed in the housing part 21. The channel selector 23 is rotationally arranged in the housing part 21, so that it can rotate about the longitudinal axis A-A of the outlet passage. The channel selector 23 provides part of the circumference of part of the length of the outlet passage 26, and the cover 51 provides another part of the circumference of that length region of the outlet passage. Thus, the channel selector 23 and the cover 51 in combination provide part of the length of the outlet passage 26.

The fastener driving tool 1 shown in the figures is a nail driving tool (i.e. a "nailer"), arranged to fire fasteners in the form of nails 27. Each nail 27 has a sleeve 29 (e.g. formed from a polymer material) located on at least part of its length. The nails 27 are arranged in strips 31, with the nails being indirectly connected to each other by means of the sleeves 29. The strips 31 of nails 27 are arranged in straight lines, with each sleeve 29 frangibly (breakably) connected to two immediately adjacent sleeves (other than the two end sleeves of the strip, each of which is connected to only one sleeve). When an end nail 27 of the strip is fired from the tool 1, the sleeve 29 located on the nail is forcibly disconnected from its adjacent sleeve by the force of the ram 7 driving the nail 27 forward with respect to the other nails in the strip, and the nail 27 together with its sleeve 29 is fired from the tool.

The magazine 19, which preferably is formed from metal and/or polymer material(s), includes an elongate frame that has two separate supply channels for holding two separate strips of nails 31, one strip in each supply channel. The supply channels are provided on opposite sides (left and right) of the frame of the magazine, divided by a central wall of the frame, and each supply channel is partially open on a side opposite the central wall, so that the nails 27 can be observed (and partially accessed). The frame of the magazine 19 is attached to the housing part 21 by partial insertion therein, and is secured thereto by means of screws. At the opposite end of the magazine, a foot 47 of the magazine is attached to the frame. The end of each supply channel at the foot end of the magazine is open, by means of apertures in the foot, to allow nail strips 31 to be inserted into the supply-channels through the foot 47. A forwardly arranged end 49 of the foot is substantially level with a forward end of the nose part 17 when the nose part is retracted, to help support the tool against a workpiece when a fastener is being fired from the tool.

Each strip of nails 31 is urged in its respective supply channel toward the channel selector 23 by means of a respective urging assembly 39 including a fastener feed device 41 including a spring-biased pusher part 43, and a roll spring (not shown). Each roll spring continuously urges its associated feed device 41 toward the channel selector 23, because one end of the roll spring is attached to the fastener feed device 41 and the opposite end of the roll spring is attached to the housing part 21. The roll spring is in a substantially unwound state when the feed device 41 is furthest from the channel selector 23, and urges the feed device 41 toward the channel selector by its tendency to achieve a fully wound state. The spring-biased pusher part 43 is biased to extend into its respective supply channel, but may be "toggled" (rotated) against a spring bias so that it is substantially clear of the channel. In this way, normally during use the pusher part 43 presses (by virtue of the roll spring) against the rear nail of the nail strip 31, to urge the nail strip toward the channel selector 23, but the pusher part 43 may be rotated out of the way to allow a new nail strip 31 to be inserted into the supply channel through an aperture in the foot 47 of the magazine 19.

One strip 31 of nails 27 at a time extends from a respective supply channel of the magazine 19 into the outlet passage 26 via the channel selector. In the preferred embodiment of the invention that is illustrated, the channel selector 23 holds three nails 27 at a time, one of which is in the outlet passage 26 of the tool. In other embodiments, the channel selector can hold more, or fewer, nails or other fasteners at a time, for example one, two, or four fasteners. Once one strip 31 of nails 27 (or other fasteners) has been almost fully used up, e.g. so that only three nails remain in the strip (i.e. there are no nails remaining in the supply channel from which the nails have been fed), the user can rotate the channel selector 23 in the housing part 21 about the longitudinal axis A-A of the outlet passage so that it is aligned with the other supply channel of the magazine, i.e. aligned with another strip of nails (or other fasteners) located in the other supply channel. In this way, the magazine 19 can hold approximately twice as many nails (or other fasteners) as would be the case if it included only one supply channel.

The nose part 17 of the fastener outlet assembly 9 includes a generally cylindrical front portion 55 (from which nails or other fasteners are expelled in use), first 57 and second 59 elongate parts extending backwards from the front portion 55, and a fixed tubular part 61 which extends forwardly from the housing part 21. The backwards movement of the second elongate part 59 when the front portion 55 of the nose part retracts enables the tool to drive a fastener into a workpiece. That is, the second elongate part 59 includes part of a mechanism (not shown), whereby a nail (or other fastener) cannot be driven from the tool unless the nose part of the tool is retracted. This mechanism is intended to ensure that the nose part of the tool is pushed against a workpiece (such that the nose part is retracted) before a fastener can be fired from the tool. Such mechanisms are well known to persons skilled in the art (e.g. from the patent publications referred to above), and thus will not be described in further detail herein.

The cover 51 includes a detector 63 rotatably mounted on an interior surface of the cover (i.e. on an underneath surface adjacent to the outlet passage 26). The detector 63 includes an elongate leg portion 65 having a pivot region 67 at one end thereof, and a foot portion 69 at the opposite end thereof. The foot portion 69 has a concave surface 71 which, when a fastener is present in the outlet passage 26, forms part of the wall(s) of the outlet passage. An opposite surface 73 of the foot portion 69 includes a recess 75 arranged to accommodate a compression spring (not shown) which biases the foot portion 69 to rotate away from the main part of the cover 51 and at least partially into the outlet passage 26. The detector 63 is arranged to rotate on its pivot region 67 about an axis oriented substantially perpendicular to the longitudinal axis A-A of the outlet passage. When a nail (or other fastener) is not present in the outlet passage 26, at least part of the foot portion 69 of the detector 63 extends into the outlet passage 26 under the bias of the compression spring. When a nail (or other fastener) is present in the outlet passage 26, the foot portion 69 of the detector 63 is prevented from extending into the outlet passage, by the nail (or other fastener).

Figure 4:
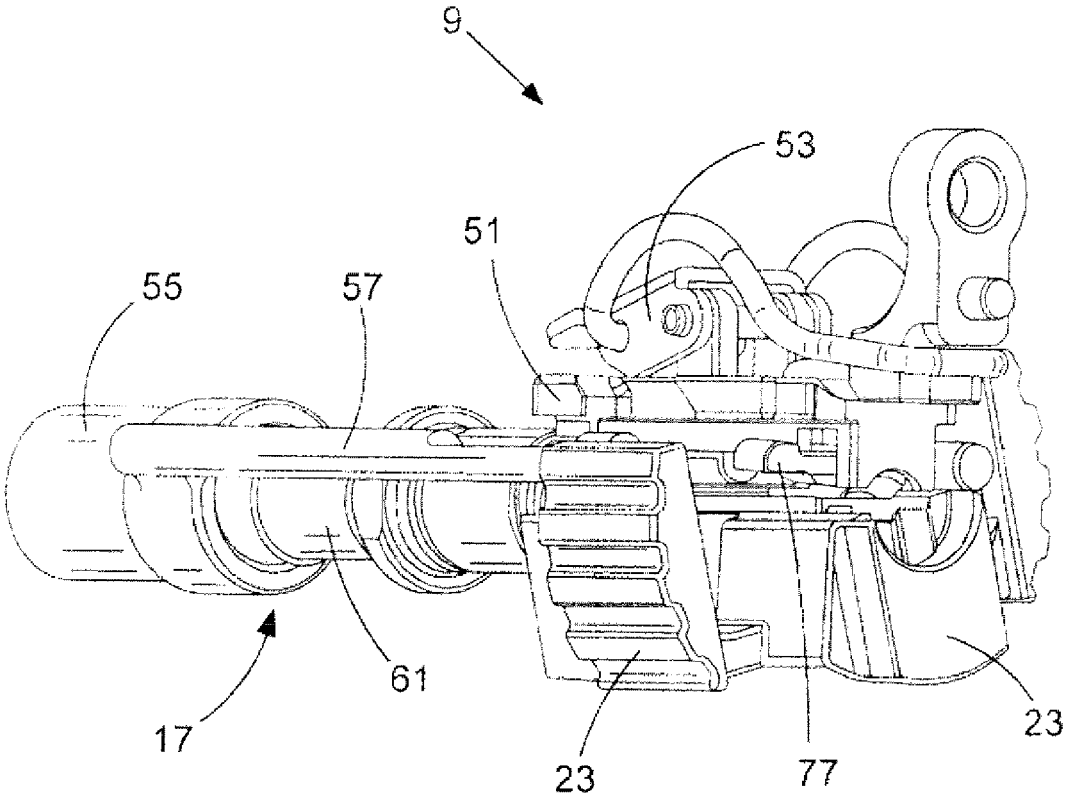
Figure 5:
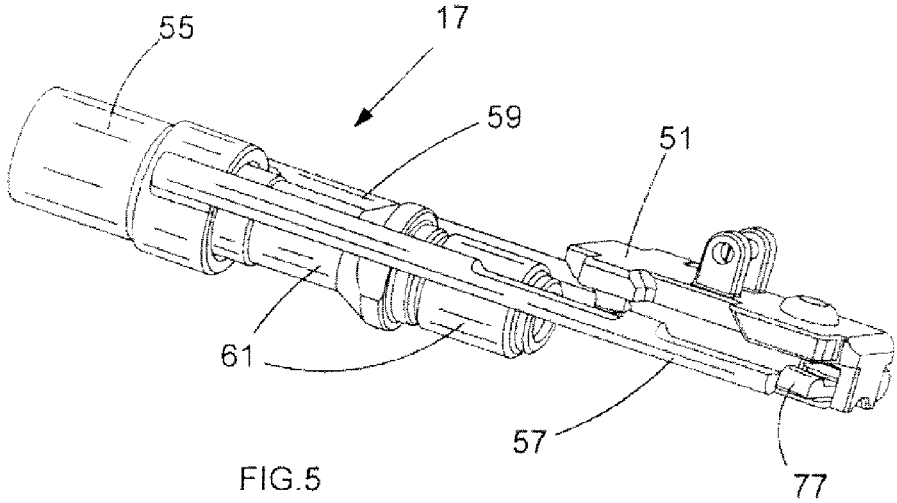
Figure 6:
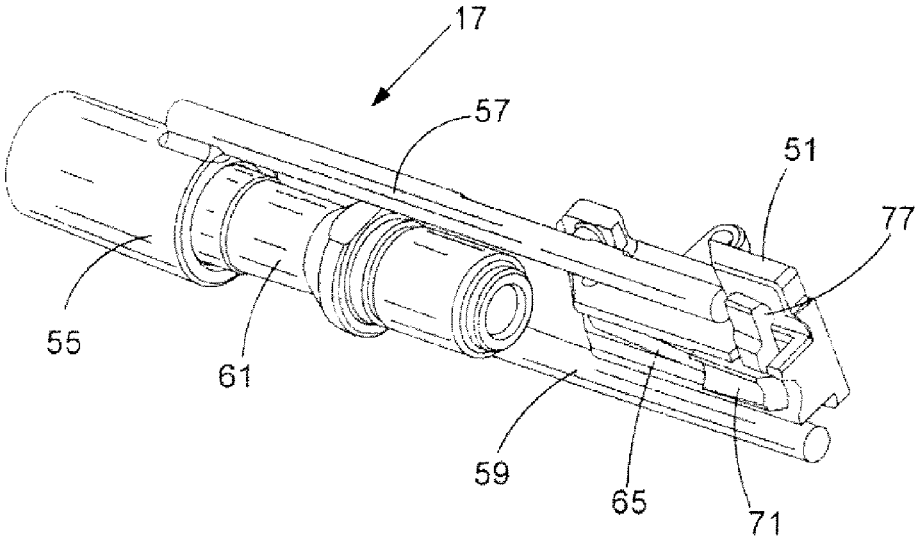
Figure 7:
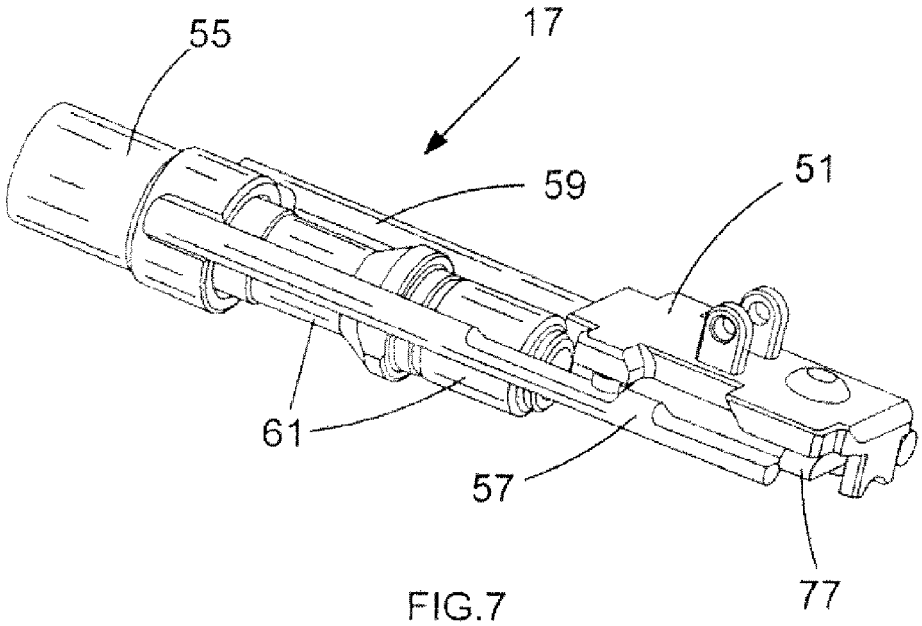
Figure 8:
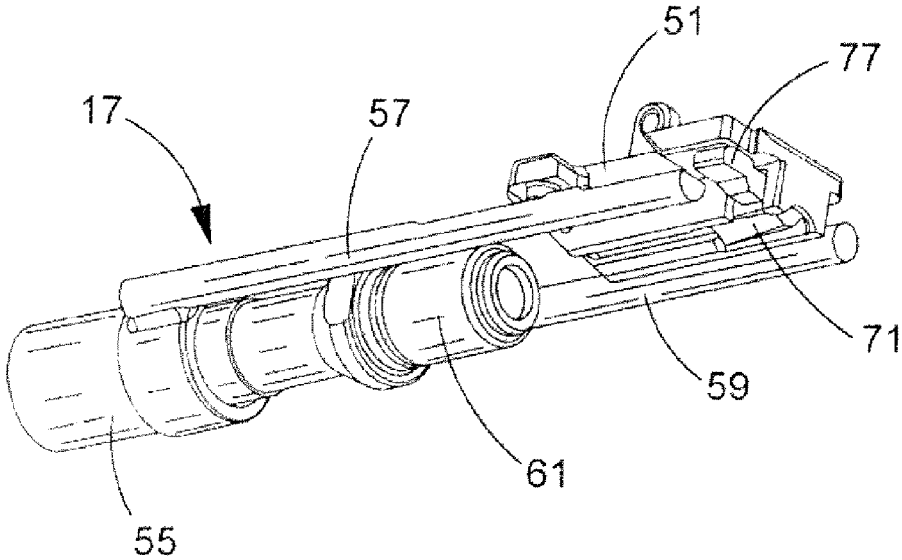
Figure 9:
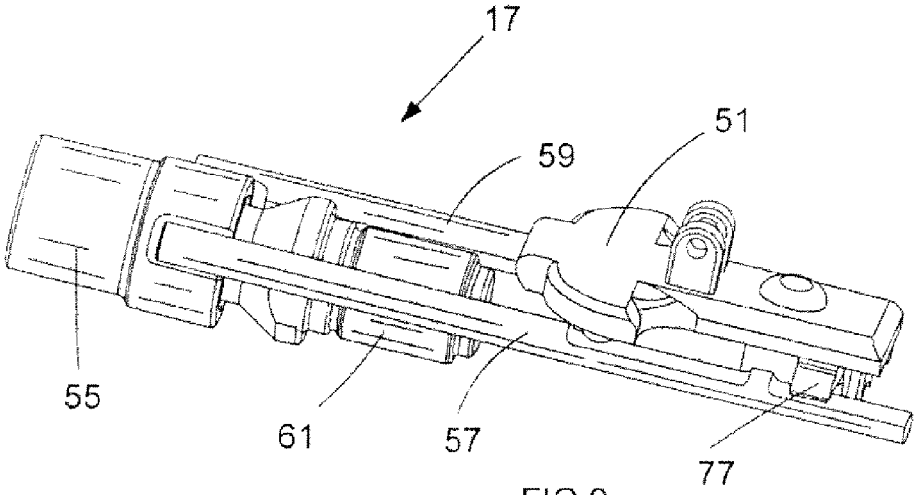
Figure 10:
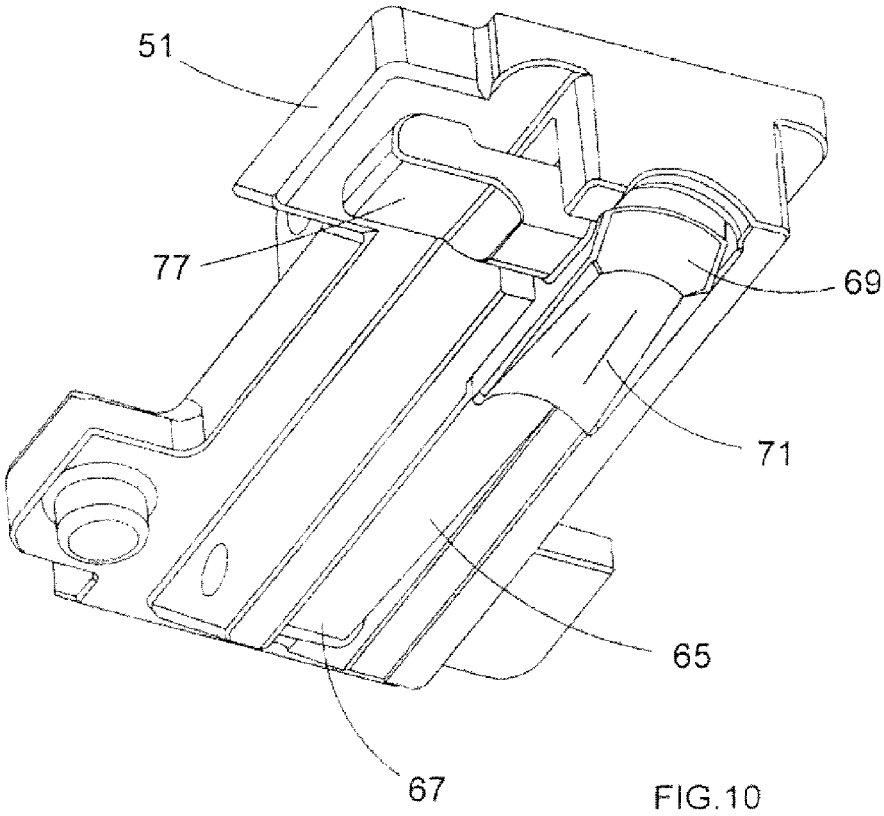
FIG. 10 is a view of a cover and detector of a fastener outlet assembly according to the invention.
Figure 11:
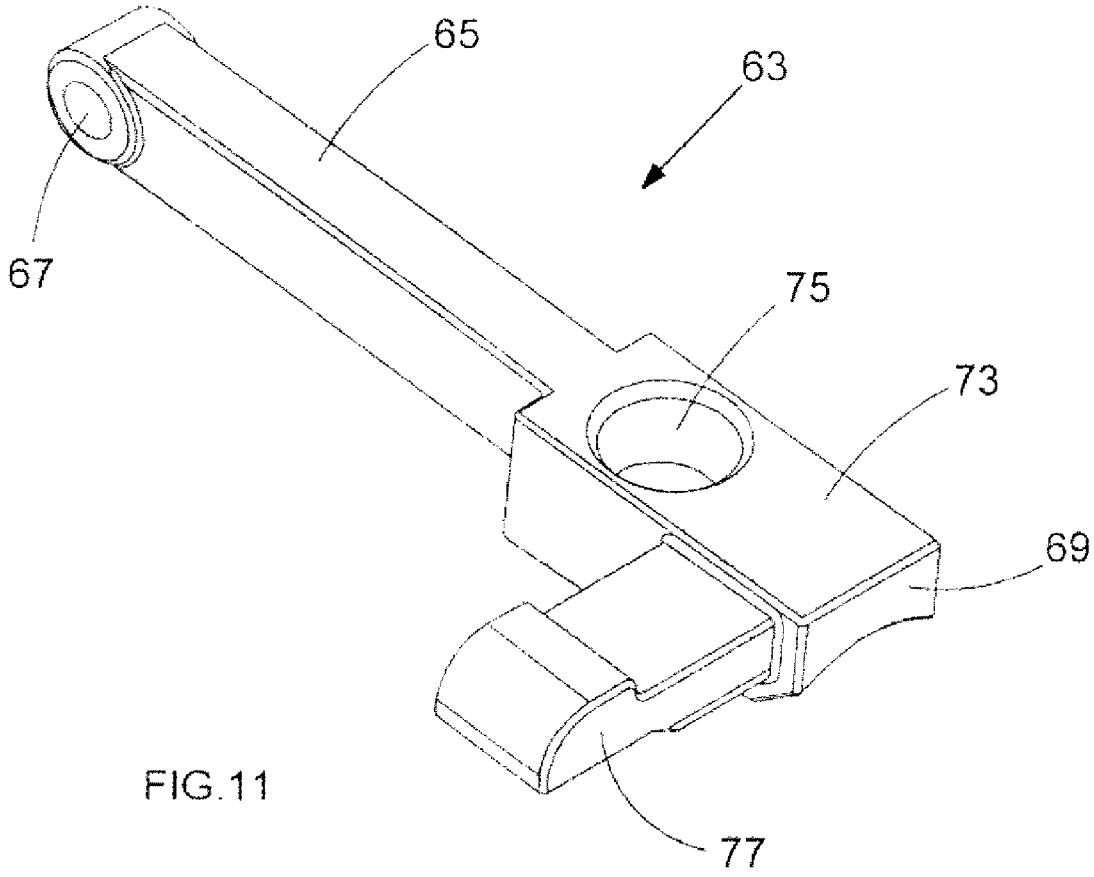
FIG. 11 is a view of a detector of a fastener outlet assembly according to the invention.

The detector 63 includes a protrusion 77 that extends laterally out of the outlet passage 26 and is positioned to block the backwards movement of the first elongate part 57 of the nose part 17 when a nail (or other fastener) is not present in the outlet passage, i.e. when the detector is in a position such that at least part of its foot portion 69 extends into the outlet passage. This position of the detector 63 is shown in FIGS. 4, 5 and 6. However, when a nail (or other fastener) is present in the outlet passage 26, the foot portion 69 of the detector has been moved out of the outlet passage and thus the lateral protrusion 77 has also been moved out of the path of the first elongate part 57 of the nose part 17. This position of the detector is shown in FIGS. 7 and 8. With the detector 63 in this position, when a user pushes the nose part 17 against a workpiece, the nose part 17 is able to retract, thereby causing the first and second elongate parts 57 and 59 of the nose part to move backwards. This configuration is shown in FIG. 9. When the second elongate part 59 is moved backwards, a mechanism of the tool allows the tool to drive a nail (or other fastener) from the outlet passage into the workpiece.

In the illustrated embodiment of the invention, the lateral protrusion 77 of the detector 63 is located inside the housing part 21, and thus is not visible from the exterior of the tool. However, in other embodiments of the invention, the lateral protrusion 77 extends to the exterior of the tool and serves as a visible indicator as to whether or not a nail (or other fastener) is present in the outlet passage.

It will be understood that the above description and the drawings are of particular examples of the invention, but that other examples of the invention are included in the scope of the claims.

We claim:

1. A fastener outlet assembly for a fastener driving tool, comprising:

an outlet passage arranged to expel fasteners from the assembly to a workpiece during use, the outlet passage having one or more walls; and a detector arranged to detect whether a fastener is present in the outlet passage, the detector comprising at least part of a cover that provides at least part of a wall of the outlet passage, the cover being movable with respect to the remaining part of the wall of the outlet passage to open the outlet passage and gain access thereto, wherein the detector comprises a protrusion that extends out of the outlet passage and is positioned to block the retraction of the nose part when a fastener is not present in the outlet passage and to allow such retraction when a fastener is present.

2. The fastener outlet assembly according to claim 1, wherein the detector further comprises an elongate leg portion having a pivot region at one end thereof, the detector arranged to rotate on its pivot region about an axis oriented substantially perpendicular to the longitudinal axis of the outlet passage.

3. The fastener outlet assembly according to claim 1, wherein the detector comprises a part of the cover.

4. The fastener outlet assembly according to claim 1, wherein the detector is mounted on the cover and is movable relative thereto.

5. The fastener outlet assembly according to claim 4, wherein the detector is rotatably mounted on the remainder of the cover.

6. The fastener outlet assembly according to claim 5, wherein the detector is arranged to rotate about an axis oriented substantially perpendicular to a longitudinal axis of the outlet passage.

7. The fastener outlet assembly according to claim 4, wherein the detector is resiliently movable such that at least a part thereof extends into the outlet passage when a fastener is not present, but is prevented from extending into the outlet passage when a fastener is present.

8. The fastener outlet assembly according to claim 1, further comprising a nose part that is resiliently retractable with respect to the outlet passage, at least a front portion of the nose part being situated in front of the cover, in a direction of expulsion of fasteners from the outlet passage.

9. The fastener outlet assembly according to claim 8, wherein the detector is arranged to prevent the nose part from retracting when a fastener is not present in the outlet passage, and to allow the nose part to retract when a fastener is present.

10. The fastener outlet assembly according to claim 1, wherein at least part of the protrusion is visible from the exterior of the assembly and serves as an indicator as to whether or not a fastener is present in the outlet passage.

11. The fastener outlet assembly according to claim 1, wherein the nose part includes a first elongate part extending backwards from the front portion.

12. The fastener outlet assembly according to claim 11, wherein the protrusion is arranged to block the backwards movement of the first elongate part when a fastener is not present in the outlet passage.

13. The fastener outlet assembly according to claim 11, wherein the nose part includes a second elongate part extending backwards from the front portion.

14. The fastener outlet assembly according to claim 1, wherein the cover is rotatable with respect to the remainder of the outlet passage.

15. The fastener outlet assembly according to claim 14, wherein the cover is arranged to rotate about an axis oriented substantially perpendicular to a longitudinal axis of the outlet passage.

16. The fastener outlet assembly according to claim 1, wherein the cover is removable from the remainder of the outlet passage.

17. The fastener driving tool arranged to drive fasteners into a workpiece, the tool including a fastener outlet assembly according to claim 1.

18. The fastener driving tool according to claim 17, wherein the fasteners comprise nails and the tool comprises a nailer.

* * * * *